US010874143B2

(12) United States Patent
Li et al.

(10) Patent No.: US 10,874,143 B2
(45) Date of Patent: Dec. 29, 2020

(54) CONNECTOR, POWER SUPPLY, AND ELECTRONIC CIGARETTE HAVING SAME

(71) Applicant: Shenzhen First Union Technology Co., Ltd., Shenzhen (CN)

(72) Inventors: Yonghai Li, Shenzhen (CN); Zhongli Xu, Shenzhen (CN); Xiaoqiang Zhao, Shenzhen (CN)

(73) Assignee: SHENZHEN FIRST UNION TECHNOLOGY CO., LTD, Shenzhen (CN)

( * ) Notice: Subject to any disclaimer, the term of this patent is extended or adjusted under 35 U.S.C. 154(b) by 679 days.

(21) Appl. No.: 15/493,064

(22) Filed: Apr. 20, 2017

(65) Prior Publication Data

US 2017/0215483 A1 Aug. 3, 2017

(30) Foreign Application Priority Data

Apr. 25, 2016 (CN) ..... 2016 2 0351433 U

(51) Int. Cl.
*A24F 47/00* (2020.01)
*H01R 24/38* (2011.01)
(Continued)

(52) U.S. Cl.
CPC ..... *A24F 47/008* (2013.01); *H01R 13/2421* (2013.01); *H01R 24/38* (2013.01); *H01R 33/22* (2013.01)

(58) Field of Classification Search
CPC ..... A24F 47/008; A24F 15/18; A24F 47/002; A24F 15/08; A24F 15/20; A24F 47/004; A24F 7/00; A24F 9/16; H01R 13/2421; H01R 24/44; H01R 13/15; H01R 13/502; H01R 13/514; H01R 13/6477;
(Continued)

(56) References Cited

U.S. PATENT DOCUMENTS 8,375,957 B2 * 2/2013 Hon ..... H05B 1/0291 131/194

FOREIGN PATENT DOCUMENTS

CN 103720055 A * 4/2014 ..... A24F 47/008
CN 204670388 U * 9/2015 ..... H05B 1/0244

OTHER PUBLICATIONS

English translation of CN-103720055-A (Year: 2014).*
English translation of CN-204670388-U (Year: 2015).*

* cited by examiner

*Primary Examiner* — Ibrahime A Abraham
*Assistant Examiner* — Chris Q Liu
(74) *Attorney, Agent, or Firm* — Cheng-Ju Chiang

(57) ABSTRACT

The present disclosure relates to an exemplary connector for an electronic cigarette, and the connector is configured for connecting an atomizer and a power supply. The connector includes a substrate served as a first electrode, a second electrode, a third electrode, and a first spring body. The substrate and the second electrode are configured for inputting power to the atomizer. The third electrode is insulated from the substrate. The second electrode nests the third electrode. The third electrode is configured for feeding back an electronic signal, and is an elastic electrode. The third electrode is movable along an axial direction of the connector relative to the second electrode. The first spring body nests the second electrode, and is configured such that the second and the third electrodes as a whole are movable along an axial direction of the connector relative to the substrate.

9 Claims, 6 Drawing Sheets

(51) Int. Cl.
*H01R 13/24* (2006.01)
*H01R 33/22* (2006.01)

(58) Field of Classification Search
CPC ..... H01R 13/65802; H01R 13/6583; H01R 13/66; H01R 13/703; H01R 2103/00; H01R 24/542; H01R 24/545; H01R 9/0527
USPC ..... 131/329, 194, 273, 347, 271, 328, 360; 392/390, 395, 386; 219/260
See application file for complete search history.

CONNECTOR, POWER SUPPLY, AND ELECTRONIC CIGARETTE HAVING SAME

TECHNICAL FIELD

The present invention relates to a connector, a power supply, and an electronic cigarette using same.

BACKGROUND ART

A typical electronic cigarette includes an atomizer and a power supply. The power supply is electrically connected to the atomizer via electrodes, and configured for feeding the atomizer power. For different atomizers, height of electrodes may be different. Accordingly, these atomizers may be unsuitable for a common power supply, thus rending unsatisfactory.

What are needed, therefore, are a connector, a power supply, and an electronic cigarette using same, which can overcome the above shortcomings.

SUMMARY

The present disclosure relates to an exemplary connector for an electronic cigarette, and the connector is configured for connecting an atomizer and a power supply. The connector includes a substrate served as a first electrode, a second electrode, a third electrode, and a first spring body. The substrate and the second electrode are configured for inputting power to the atomizer. The third electrode is insulated from the substrate. The second electrode nests the third electrode. The third electrode is configured for feeding back an electronic signal, and is an elastic electrode. The third electrode is movable along an axial direction of the connector relative to the second electrode. The first spring body nests the second electrode, and is configured such that the second and the third electrodes as a whole are movable along an axial direction of the connector relative to the substrate.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
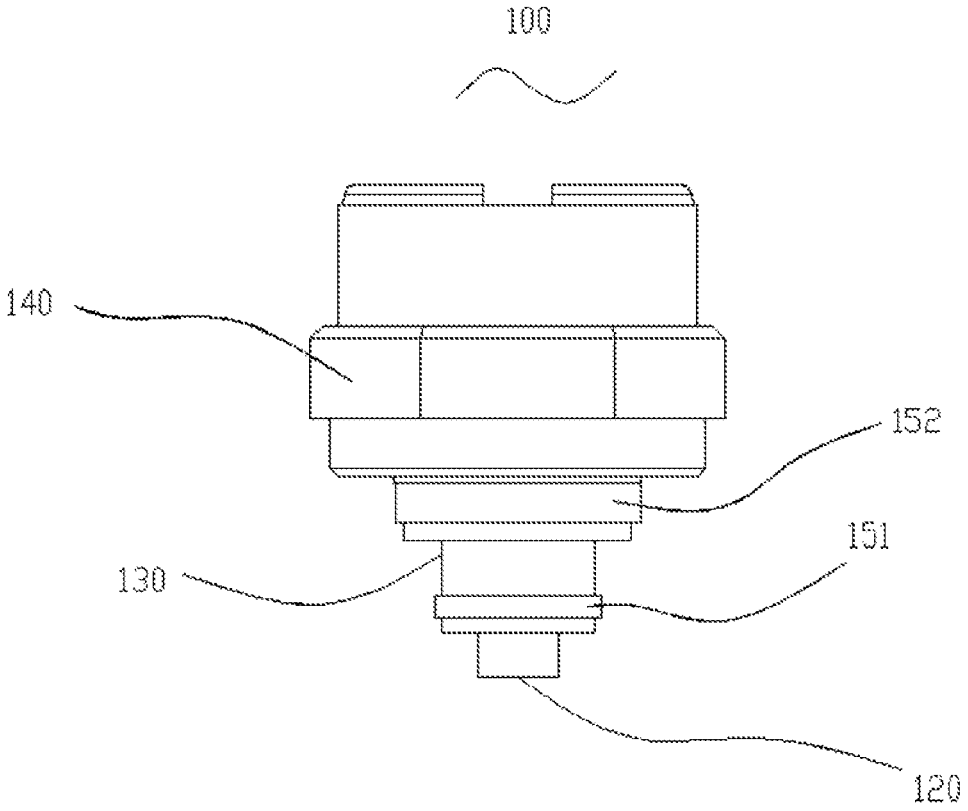
FIG. 1 is a side view of a connector according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
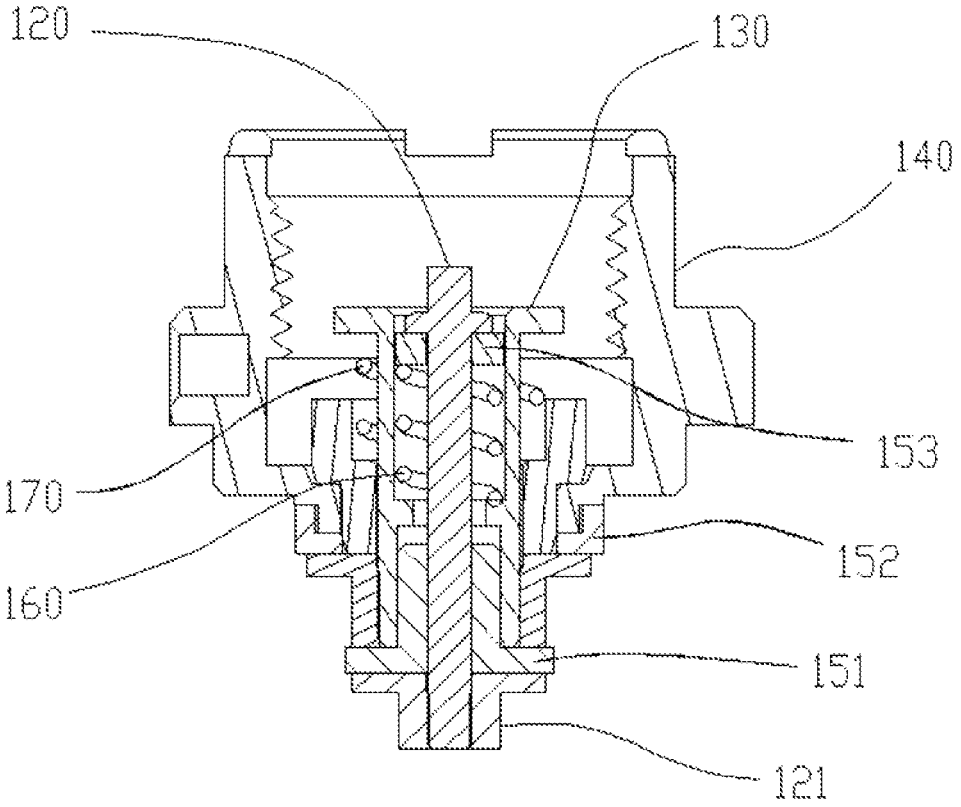
FIG. 2 is a cross-sectional view of the connector of FIG. 1.

Referring to FIGS. 1-2, a connector 100 for an electronic cigarette is shown. The connector 100 is configured (i.e., structured and arranged) for electrically connecting an atomizer 300 and a power supply 200. The connector 100 includes a substrate 140 as a first electrode, a second electrode 130 arranged beside the substrate 140, and a third electrode 120 arranged beside the substrate 140. Both of the second and the third electrodes are insulated from the substrate 140. The second electrode 130 nests the third electrode 120, and is configured for feeding back a signal of the atomizer 300. The substrate 140 and the second electrode 130 are configured for supplying the atomizer 300 power. The third electrode 120 is an elastic electrode arranged in the second electrode 130. The third electrode 120 is movable along an axial direction of the connector 100 relative to the second electrode 130. The second electrode 130 is nested by a first spring body 170. The first spring body 170 is configured such that the second electrode 130 and the third electrode 120 as a whole are movable along the axial direction of the connector 100 relative to the substrate 140.

Referring to FIG. 2, two insulators 151, 153 are provided at two opposite ends of the third electrode 120, so that the third electrode 120 is insulated from the second electrode 130. An insulator 152 is arranged between the substrate 140 and the second electrode 130, so that the substrate 140 insulated from the second electrode 130. In the present embodiment, the insulators 151, 153 are both fixed on the third electrode 120. A second spring body 160 nests the third electrode 120, and is positioned between the insulators 151, 153. One end of the second spring body 160 abuts against an insulator 153; the other end abuts against the second electrode 130. The second spring body 160 is not in contact with the third electrode 120. The second spring body 160 is configured such that the third electrode 120 is movable along the axial direction the connector 100 relative to the second electrode 130.

In the present embodiment, the first and the second spring bodies 170, 160 both are springs. In other embodiments, the first and the second spring bodies 170 may be elastic pieces, and so on.

Referring to FIG. 2, two opposite ends of the third electrode 120 protrude out of the second electrode 130. The substrate 140 includes a plurality of screw threads formed on an end connecting an external electrode. The end of the substrate 140 protrudes from the third electrode 120, and the second electrode 130.

Figure 3:
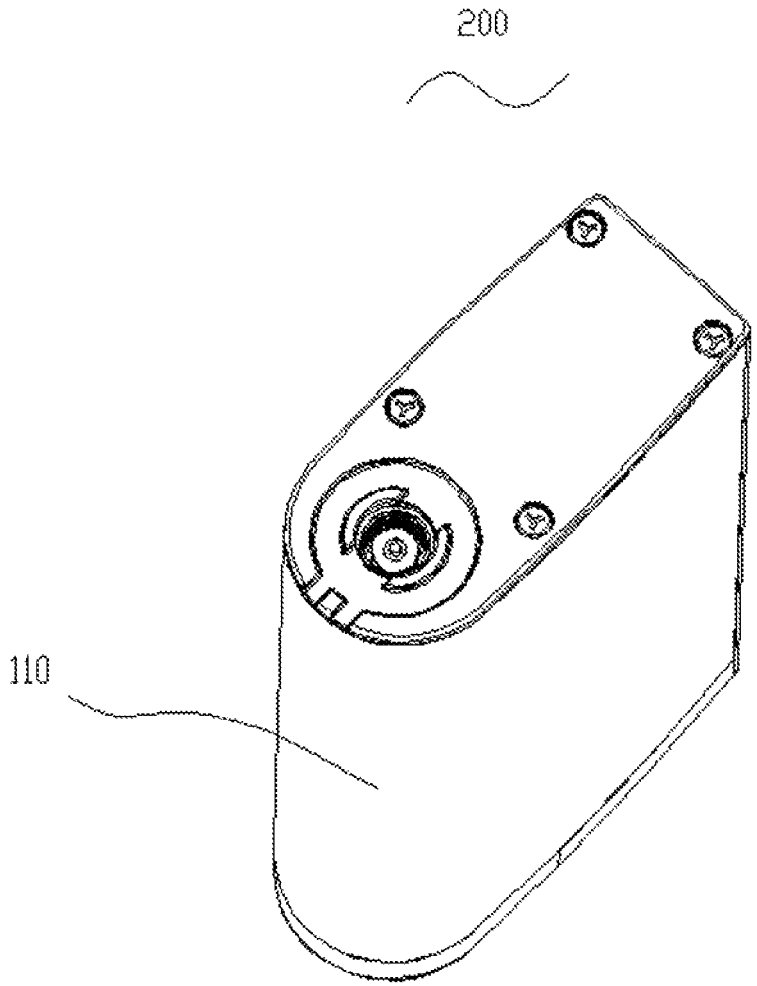
FIG. 3 is a perspective view of a power supply according to a second embodiment.
Figure 4:
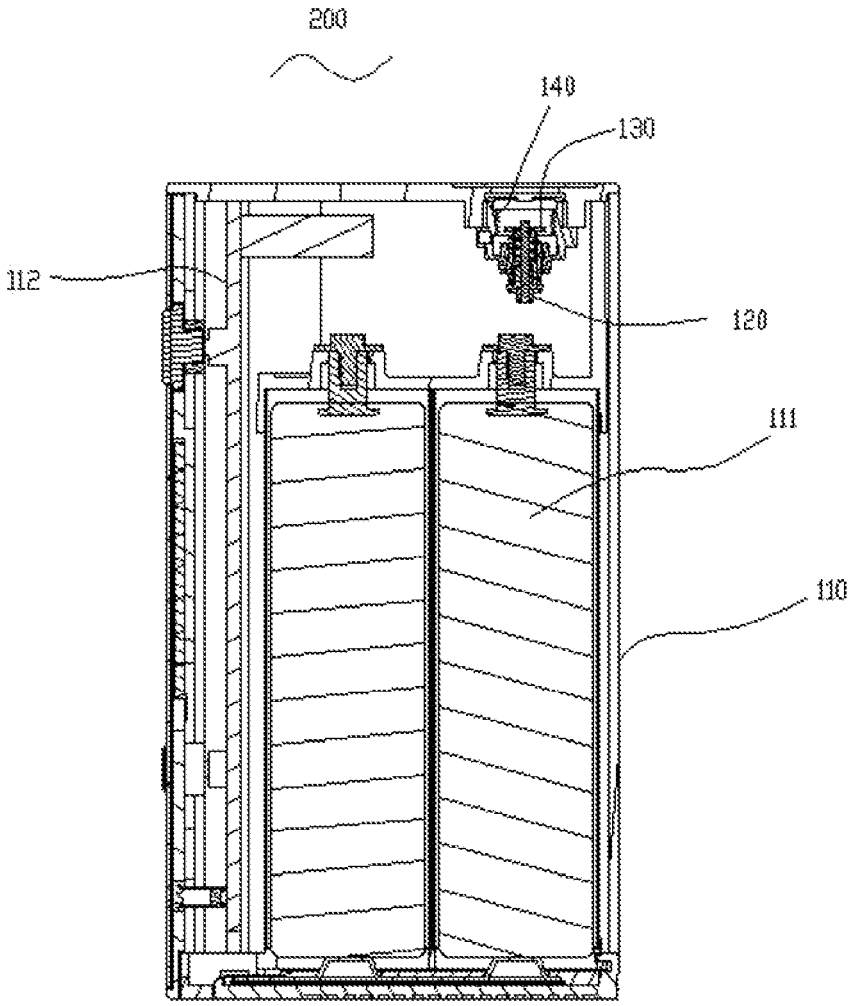
FIG. 4 is a cross-sectional view of the power supply of FIG. 3.
Figure 6:
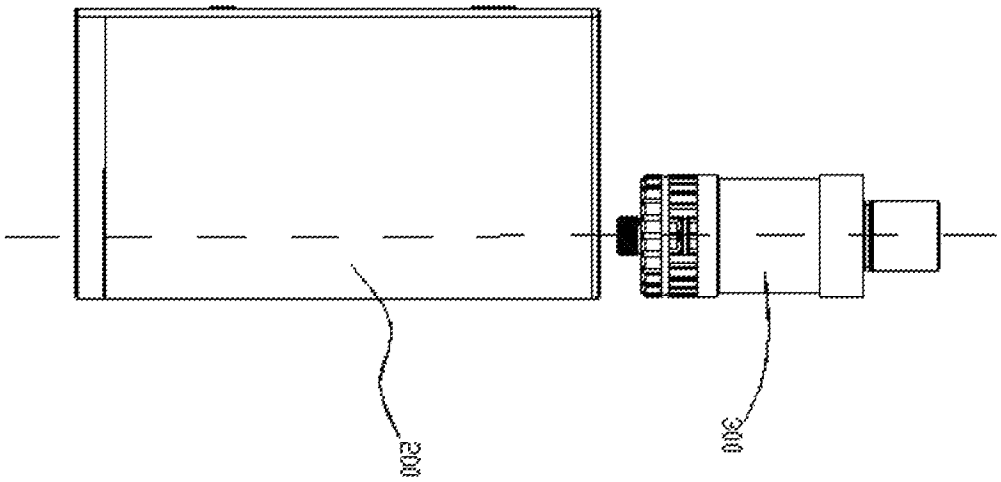
FIG. 6 is a side view of an electronic cigarette according to a fourth embodiment.

Referring to FIGS. 3-4, a power supply 200 for an electronic cigarette is shown. The power supply 200 is configured for coupling with an atomizer 300 (as seen in FIG. 6). The power supply 200 includes a housing 110, a battery 111 arranged in the housing 110, and a control circuit 112 arranged in the housing 110. A connector of the first embodiment is provided at an end of the housing 110.

In detail, the third electrode 120 is configured for feeding back a signal of the atomizer 300, e.g., a temperature signal of a heating wire, or a temperature signal of aerosol. The second electrode 130 and the substrate 140 are configured for feeding the atomizer power. In the present embodiment, the second electrode 130 is a positive electrode, and the substrate 140 is a negative electrode. In a feedback circuit, the third electrode 120 and the substrate 140 form a circuit loop.

Figure 5:
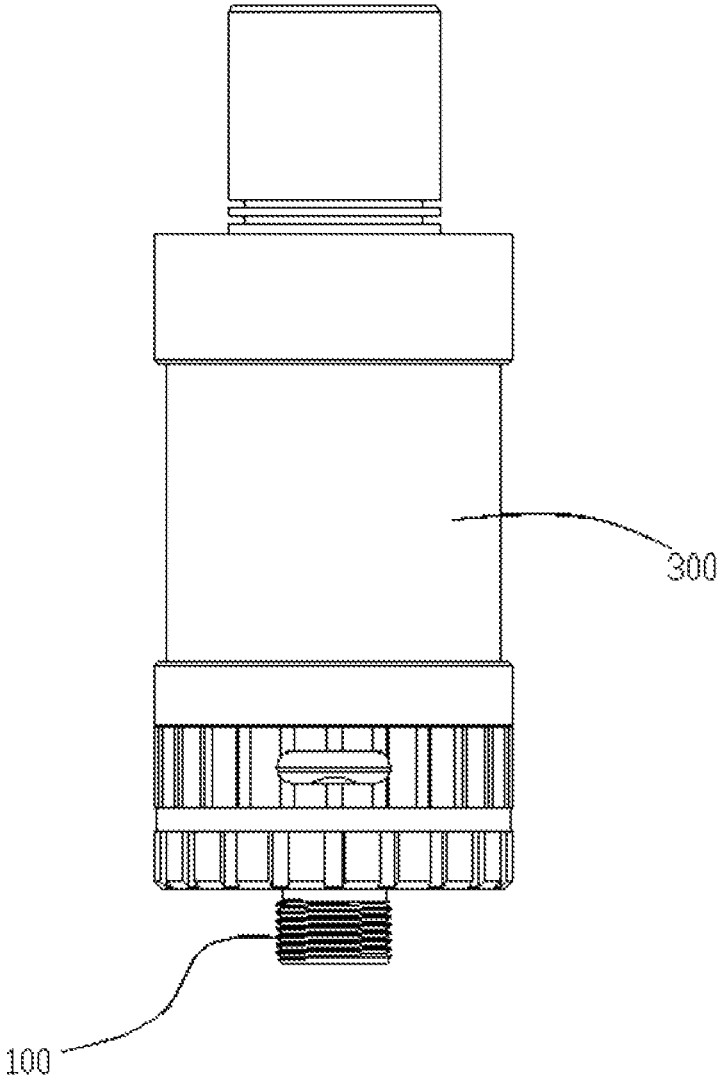
FIG. 5 is a side view of an atomizer according to a third embodiment.

Referring to FIG. 5, it is to be understood that the connector 100 of the first embodiment, can also be arranged at an end of the atomizer 300.

Referring to FIG. 6, an electronic cigarette is shown. The electronic cigarette includes an atomizer 300, and the above described power supply 200. The power supply 200 is detachably connected with the atomizer 300, e. g., via screw threads. The power supply 200 is configured for supplying the atomizer 300 power.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A connector for an electronic cigarette, the connector being configured for connecting an atomizer and a power supply, the connector comprising:

a substrate served as a first electrode;

a second electrode arranged beside the substrate, the second electrode being insulated from the substrate, the substrate and the second electrode being configured for inputting power to the atomizer;

a third electrode arranged beside the substrate, the third electrode being insulated from the substrate and the second electrode, the second electrode being disposed to surround the third electrode, the third electrode being configured for feeding back an electronic signal acquired from the atomizer, the third electrode being an elastic electrode, the third electrode being movable along an axial direction of the connector relative to the second electrode;

a first spring body disposed to surround the second electrode, the first spring body being configured such that the second and the third electrodes as a whole are movable along an axial direction of the connector relative to the substrate; and two insulators and a second spring body, wherein the two insulators are arranged at two opposite ends of the third electrode, the two insulators are configured for keeping the third electrode insulated from the second electrode, the third electrode is nested in the second spring body, a first end of the second spring body abuts against one of the two insulators, an opposite second end of the second spring body abuts against the second electrode, and the second spring body is configured such that the third electrode is movable along the axial direction of the connector relative to the second electrode.

2. The connector according to claim 1, wherein the second spring body comprises a spring.

3. The connector according to claim 1, wherein two opposite ends of the third electrode extend out of the second electrode.

4. The connector according to claim 1, further comprising a plurality of screw threads formed at an end of the substrate.

5. The connector according to claim 1, wherein the first spring body comprises a spring.

6. The connector according to claim 1, wherein an end of the substrate protrudes from the second and the third electrode.

7. A power supply for an electronic cigarette, comprising: a housing; a battery arranged in the housing; a control circuit arranged in the housing; and a connector according to claim 1, the connector being arranged at an end of the housing.

8. An electronic cigarette, comprising: an atomizer; and a power supply of claim 7, the power supply being configured for supplying the atomizer power.

9. A connector for an electronic cigarette, the connector being configured for connecting an atomizer and a power supply, the connector comprising:

a substrate served as a first electrode;

a second electrode arranged beside the substrate, the second electrode being insulated from the substrate, the substrate and the second electrode being configured for inputting power to the atomizer;

a third electrode arranged beside the substrate, the third electrode being insulated from the substrate, the second electrode being disposed to surround the third electrode, the third electrode being configured for feeding back an electronic signal, the third electrode being an elastic electrode, the third electrode being movable along an axial direction of the connector relative to the second electrode;

a first spring body disposed to surround the second electrode, the first spring body being configured such that the second and the third electrodes as a whole are movable along an axial direction of the connector relative to the substrate; and two insulators and a second spring body, wherein the two insulators are arranged at two opposite ends of the third electrode, the two insulators are configured for keeping the third electrode insulated from the second electrode, the third electrode is nested in the second spring body, a first end of the second spring body abuts against one of the two insulators, an opposite second end of the second spring body abuts against the second electrode, and the second spring body is configured such that the third electrode is movable along the axial direction of the connector relative to the second electrode.

* * * * *